US011496854B2

(12) United States Patent
Preiss et al.

(10) Patent No.: US 11,496,854 B2
(45) Date of Patent: Nov. 8, 2022

(54) MOBILITY BASED AUDITORY RESONANCE MANIPULATION

(71) Applicant: International Business Machines Corporation, Armonk, NY (US)

(72) Inventors: Tanner Mark Preiss, Schnecksville, PA (US); Christian Compton, Austin, TX (US); Jeremy R. Fox, Georgetown, TX (US); Sarbajit K. Rakshit, Kolkata (IN)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 17/187,903

(22) Filed: Mar. 1, 2021

(65) Prior Publication Data

US 2022/0279307 A1 Sep. 1, 2022

(51) Int. Cl.

| | |
|---|---|
| ***H04R 29/00*** | (2006.01) |
| ***H04S 7/00*** | (2006.01) |
| ***G10L 21/0216*** | (2013.01) |

(52) U.S. Cl.

CPC ..... *H04S 7/308* (2013.01); *G10L 21/0216* (2013.01); *H04S 2400/13* (2013.01)

(58) Field of Classification Search

CPC ... H04S 7/308; H04S 2400/13; G10L 21/0216
USPC ..... 381/58, 104, 59
See application file for complete search history.

(56) References Cited

U.S. PATENT DOCUMENTS

| | | | | |
|---|---|---|---|---|
| 5,668,884 | A | 9/1997 | Clair, Jr. | |
| 8,831,255 | B2 | 9/2014 | Crawford | |
| 2009/0161880 | A1 | 6/2009 | Hooley | |
| 2010/0042925 | A1 | 2/2010 | Demartin | |
| 2011/0221657 | A1 | 9/2011 | Haddick | |
| 2013/0121515 | A1 | 5/2013 | Hooley | |
| 2016/0080866 | A1* | 3/2016 | Agustin | H03G 3/3005 381/77 |
| 2017/0055100 | A1 | 2/2017 | Wong | |
| 2018/0082682 | A1 | 3/2018 | Erickson | |
| 2019/0121522 | A1 | 4/2019 | Davis | |
| 2020/0033943 | A1 | 1/2020 | Swaminathan | |

(Continued)

FOREIGN PATENT DOCUMENTS

CN 103938979 A 7/2014

OTHER PUBLICATIONS

"Virtual and Augmented Reality Market is Expected to Exceed US$ 117 Billion by 2022", Heraldkeeper, Published: Jul. 26, 2018, 7 pages, <https://www.marketwatch.com/amp/story/guid/91318804-1de8-4bbf-a6e8-697402241dbc>.

(Continued)

*Primary Examiner* — Ammar T Hamid
(74) *Attorney, Agent, or Firm* — Brian M. Restauro

(57) ABSTRACT

Embodiments of the present invention provide methods, computer program products, and systems. Embodiments of the present invention can map an environment comprising one or more locations having respective objects located within each of the one or more locations based on received information. Embodiments of the present invention can then dynamically determine appropriate auditory levels for the environment. Embodiments of the present invention can then adjust auditory levels of each of the one or more rooms within the environment to match the determined auditory level.

17 Claims, 4 Drawing Sheets

(56) References Cited

U.S. PATENT DOCUMENTS

| | | | | |
|---|---|---|---|---|
| 2020/0059748 | A1 | 2/2020 | Fox | |
| 2021/0092232 | A1 * | 3/2021 | Norris | H04S 1/005 |

OTHER PUBLICATIONS

Disclosed Anonymously, "Method and System for Providing Sound Source Identity, Status, and Contextually Personalized Operation in Augmented Reality", an IP.com Prior Art Database Technical Disclosure, IP.com No. IPCOM000260063D, IP.com Electronic Publication Date: Oct. 17, 2019, 5 pages.

Disclosed Anonymously, "Selective Audio Control for Sound Sources in a Volumetric Display", an IP.com Prior Art Database Technical Disclosure, IP.com No. IPCOM000238801D, IP.com Electronic Publication Date: Sep. 18, 2014, 4 pages.

Harma et al., "Augmented Reality Audio for Mobile and Wearable Appliances*", J. Audio Eng. Soc., vol. 52, No. 6, Jun. 2004, 22 pages.

Robertson, Adi, "Bose's augmented reality glasses use sound instead of sight", The Verge, Mar. 12, 2018, 5 pages, <https://www.theverge.com/2018/3/12/17106688/bose-ar-audio-augmented-reality-glasses-demo-sxsw-2018>.

Widman, Jake, "AR and VR bring a new twist to collaboration", Computerworld, Jan. 3, 2019, 8 pages, <https://www.computerworld.com/article/3329746/ar-and-vr-bring-a-new-twist-to-collaboration.html>.

* cited by examiner

MOBILITY BASED AUDITORY RESONANCE MANIPULATION

BACKGROUND

The present invention relates in general to audio normalization and in particular to dynamically adjusting audio levels based on a user's location.

Augmented reality (AR) generally refers to an interactive experience of a real-world environment where the objects that reside in the real world are enhanced by computer-generated perceptual information, sometimes across multiple sensory modalities, including visual, auditory, haptic, somatosensory and olfactory. AR can be defined as a system that fulfills three basic features: a combination of real and virtual worlds, real-time interaction, and accurate 3D registration of virtual and real objects. The overlaid sensory information can be constructive (i.e., additive to the natural environment), or destructive (i.e. masking of the natural environment). This experience is seamlessly interwoven with the physical world such that it is perceived as an immersive aspect of the real environment. In this way, augmented reality alters one's ongoing perception of a real-world environment, whereas virtual reality completely replaces the user's real-world environment with a simulated one.

Audio normalization typically refers to an application of a constant amount of gain to an audio recording to bring the amplitude to a target level (the norm). Because the same amount of gain is applied across the entire recording, the signal-to-noise ratio and relative dynamics are unchanged. Two principal types of audio normalization exist. Peak normalization adjusts the recording based on the highest signal level present in the recording. Loudness normalization adjusts the recording based on perceived loudness.

3D sound localization refers to an acoustic technology that is used to locate the source of a sound in a three-dimensional space. The source location is usually determined by the direction of the incoming sound waves (horizontal and vertical angles) and the distance between the source and sensors. It involves the structure arrangement design of the sensors and signal processing techniques.

SUMMARY

According to an aspect of the present invention, there is provided a computer-implemented method. The computer implemented method comprises mapping an environment comprising one or more locations having respective objects located within each of the one or more locations based on received information; dynamically determining appropriate auditory levels for the environment; and adjusting auditory levels of each of the one or more rooms within the environment to match the determined auditory level.

BRIEF DESCRIPTION OF THE DRAWINGS

Preferred embodiments of the present invention will now be described, by way of example only, with reference to the following drawings, in which.

DETAILED DESCRIPTION

Embodiments of the present invention recognize that clarity of audio played and subsequently heard by a user can be affected by multiple factors. For example, clarity of sound and corresponding intensity (i.e., loudness) can depend on factors such as distance, objects within an environment, humidity, sound absorption material, etc. Embodiments of the present invention recognize deficiencies with audio normalization and 3D sound localization. Specifically, external sound can interfere or otherwise cause distortion for a user's listening experience. As such, embodiments of the present invention dynamically adjust auditory levels within an environment such that a user can have optimal sound quality (i.e., clarity) at a location where there the user is listening. For example, embodiments of the present invention can take active steps to mitigate detected audio that either actively interferes with audio playback or could potentially interfere with audio playback as discussed in greater detail later in this Specification.

Figure 1:
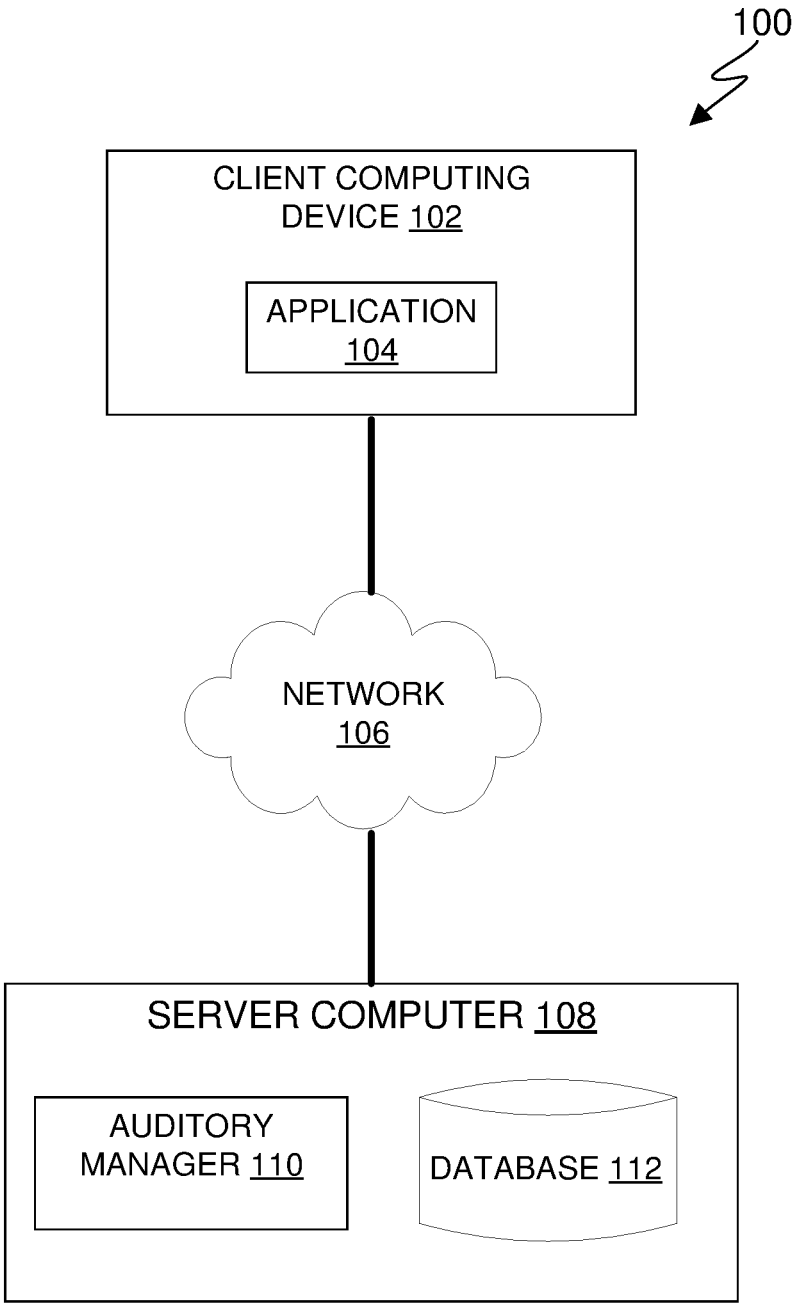
FIG. 1 depicts a block diagram of a computing environment, in accordance with an embodiment of the present invention.

FIG. 1 is a functional block diagram illustrating a computing environment, generally designated, computing environment 100, in accordance with one embodiment of the present invention. FIG. 1 provides only an illustration of one implementation and does not imply any limitations with regard to the environments in which different embodiments may be implemented. Many modifications to the depicted environment may be made by those skilled in the art without departing from the scope of the invention as recited by the claims.

Computing environment 100 includes client computing device 102 and server computer 108, all interconnected over network 106. Client computing device 102 and server computer 108 can be a standalone computer device, a management server, a webserver, a mobile computing device, or any other electronic device or computing system capable of receiving, sending, and processing data. In other embodiments, client computing device 102 and server computer 108 can represent a server computing system utilizing multiple computer as a server system, such as in a cloud computing environment. In another embodiment, client computing device 102 and server computer 108 can be a laptop computer, a tablet computer, a netbook computer, a personal computer (PC), a desktop computer, a personal digital assistance (PDA), a smart phone, or any programmable electronic device capable of communicating with various components and other computing devices (not shown) within computing environment 100. In another embodiment, client computing device 102 and server computer 108 each represent a computing system utilizing clustered computers and components (e.g., database server computers, application server computers, etc.) that act as a single pool of seamless resources when accessed within computing environment 100. In some embodiments, client computing device 102 and server computer 108 are a single device. Client computing device 102 and server computer 108 may include internal and external hardware components capable of executing machine-readable program instructions, as depicted and described in further detail with respect to FIG. 4.

In this embodiment, client computing device 102 is a user device associated with a user and includes application 104. Application 104 communicates with server computer 108 to access auditory manager 110 (e.g., using TCP/IP) to access content, user information, and database information. Application 104 can further communicate with auditory manager 110 to transmit instructions to dynamically adjust auditory levels within an environment such that a user can have optimal sound quality (i.e., clarity) at a location where there the user is listening as discussed in greater detail with regard to FIGS. 2-4.

Network 106 can be, for example, a telecommunications network, a local area network (LAN), a wide area network (WAN), such as the Internet, or a combination of the three, and can include wired, wireless, or fiber optic connections. Network 106 can include one or more wired and/or wireless networks that are capable of receiving and transmitting data, voice, and/or video signals, including multimedia signals that include voice, data, and video information. In general, network 106 can be any combination of connections and protocols that will support communications among client computing device 102 and server computer 108, and other computing devices (not shown) within computing environment 100.

Server computer 108 is a digital device that hosts auditory manager 110 and database 112. In this embodiment, auditory manager 110 resides on server computer 108. In other embodiments, auditory manager 110 can have an instance of the program (not shown) stored locally on client computer device 102. In other embodiments, auditory manager 110 can be a standalone program or system dynamically adjusts auditory levels within an environment such that a user can have optimal sound quality (i.e., clarity and same level of measured loudness) at a location where there the user is listening. In yet other embodiments, auditory manager 110 can be stored on any number or computing devices.

Auditory manager 110 dynamically adjusts auditory levels within an environment such that a user can have optimal sound quality (i.e., clarity) at a location where there the user is listening. For example, auditory manager 110 can automatically execute one or more actions to ensure a same level of audio can be maintained or restored to an optimal location for the user. In this embodiment, auditory manager 110 dynamically adjusts auditory levels within an environment by receiving information, mapping an environment based on the received information, dynamically determine appropriate auditory levels, and subsequently adjust auditory levels based on the determination.

In this embodiment, auditory manager 110 dynamically determines appropriate auditory levels based on user preference and location. In this embodiment, user preference can be as specific as a desired decibel (dB) range for one or more areas in an environment. For example, a user can specify a limit of 40 dB to surrounding areas. Specifically, the user can select the types of sounds, various contextual situations and accordingly set the level of loudness of sound in the surrounding area (e.g., Room #1—Volume Level and marker set, Room #2—Volume Level and marker set, Room #3—Volume Level and marker set, Room #4—Volume Level and marker set). In this manner, auditory manager 110 can generate a baseline rule set for sounds and conditions. Using historical records, machine learning, and predictive algorithms, auditory manager 110 can, in some embodiments, automatically create rules for certain sounds and circumstances.

An environment, as used herein, refers to a physical location in proximity of a user. For example, an environment can be a user's home and areas (i.e., locations or distinct rooms) of an environment. In most scenarios, an environment refers to an enclosed space in which audio can be heard. An environment can include one or more objects that affect audio (i.e., noise). For example, objects can include one or more pieces of furniture, materials used in the home (e.g., sound deadening material, walls, floors, speakers, electronic devices, rungs, light fixtures, fans, kitchen appliances, windows, window treatments, etc.). In certain circumstances, an environment can refer to a static area of the environment (e.g., a specific room of the house). In other circumstances, an environment can be dynamic. For example, an environment can refer to any location a user in and change dynamically as the user moves from one location to another (e.g., walking from the living room to the kitchen, up the staircase, and into the office).

In some embodiments, auditory manager 110 can dynamically determine appropriate auditory level based on a likelihood of a detected noise (i.e., audio emanating from a source) interfering with audio currently being broadcasted (or otherwise selected to play) to a user. For example, auditory manager 110 can reference a decibel table for known audible ranges of devices that can be found in an environment. Using a combination of artificial intelligence algorithms, auditory manager 110 can predict the likelihood of an object to produce sound and take appropriate actions to adjust auditory levels of the object before the object produces the sound.

In some embodiments, auditory manager 110 can dynamically determine appropriate auditory levels based on a current contextual situations (e.g., segments of time designated as having specified levels of acceptable noise). For example, auditory manager 110 can determine appropriate auditory levels for certain types of activity like studying, sleeping, lounging, energy stimulating, etc.). In these embodiments auditory manager 110 can also prioritize and determine appropriate auditory levels based on type and source of sound (e.g., noise generated from within or external to the environment) and comparative priority of the activity making the noise (e.g., the washer/dryer, kitchen appliance, ceiling fan, speaker, human, animal, etc.).

In this embodiment, auditory manager 110 can adjust auditory levels by manipulating one or more devices connected to an environment of the user. For example, where auditory manager 110 manages auditory levels of a user's home, auditory manager 110 can detect the source of an audio causing interference and subsequently increase or decrease (i.e., reduce) the volume of source, enable sound booster of a speaker system producing the sound, reduce the distance from the source of sound (e.g., by bringing an object closer to the user), close or open door, and in some instances, transmit instructions to a connected device to remove obstacles producing the unwanted obstacle causing the audio. For example, in some embodiments auditory manager 110 can retract window treatments (e.g., window shades, blinds, curtains, etc.) to minimize noise (i.e., control a volume level of noise) from outside the environment (i.e., noise coming in from the windows).

In certain circumstances, auditory manager 110 can dynamically adjust a room's sound profile according to the location of the user. For example, where a user has a wireless stereo system, auditory manager can optimize room settings such that the user maintains the same level of audio preference as the user walks through rooms (e.g., by increasing volume levels of speakers the user is walking through (e.g., walking from the office through the kitchen) and adjusting speaker volume levels of the room the user stops walking (e.g., living room). In instances where a user is active, that is, changing locations, auditory manager 110 can use any combination of facial recognition and gait analysis algorithms to predict and track the user's location (with user permission and ability to opt-out of the service). In other embodiments, auditory manager 110 can track a device associated with the user to determine the user's location, provided the user is within close proximity to (i.e., carrying) the device.

In this embodiment, auditory manager 110 can be utilized with augmented reality. For example, auditory manager 110 can have an interface displayed on an augmented reality display such as smart glasses. In this embodiment, auditory manager 110 can display a layout of the environment the user is in and display images that overlay physical devices to show where audio (noise or selected audio content) is coming from. Auditory manager 110 can also display a control or command center that allows volume control over one or more detected audio. For example, where an environment comprises two rooms, auditory manager 110 can detect that Room A includes a three stereo system that is broadcasting selected audio and that room B has an object (e.g., a ceiling fan) that is generating noise or otherwise emanating audio (e.g., a creak and fan noise). In this example, auditory manager 110 determines that there are four objects that are producing noise (e.g., the three speakers in Room A and the fan in Room B. Accordingly, auditory manager 110 can generate volume icons for each of the detected objects that have a sliding graphic that, when interacted with, can adjust the volume of the detected object. In this example, auditory manager 110 can, in response to determining that the fan in Room B interferes with audio from the three speakers, can automatically adjust the fans speed of the fan to reduce wind noise and creaking. Alternatively, auditory manager 110 can transmit instructions and subsequently execute those instructions to shut off the fan thereby eliminating the interfering or unwanted noise.

Regardless of the action, auditory manager 110 can generate graphical icons (i.e., a display marker) that when interacted with can control volume over one or more detected audio. For example, using an augmented reality device, a user can visually look at an object (e.g., a speaker), look at a graphic display icon displayed in the augmented reality device, interact with the graphic display icon and mute that object. In certain situations, auditory manager 110 can group certain graphical icons. For example, auditory manager 110 can identify one or more objects emitting sound and respective locations for each of the one or more objects, generate graphic icons that, when interacted with can control volume levels of each of the one or more objects, and display the generate graphic icons to the user as a group in an augmented reality display. Auditory manager 110 can then receive instruction from the user to mute or otherwise adjust sound levels for the group or each object individually. In certain circumstances, auditory manager 110 may automatically determine an appropriate action and adjust respective volume levels of each of the one or more objects or adjust the volume level of the group of the objects.

Database 112 stores received information and can be representative of one or more databases that give permissioned access to auditory manager 110 or publicly available databases. For example, database 112 can store environment information associated with the user. In general, database 112 can be implemented using any non-volatile storage media known in the art. For example, database 112 can be implemented with a tape library, optical library, one or more independent hard disk drives, or multiple hard disk drives in a redundant array of independent disk (RAID). In this embodiment database 112 is stored on server computer 108.

Figure 2:
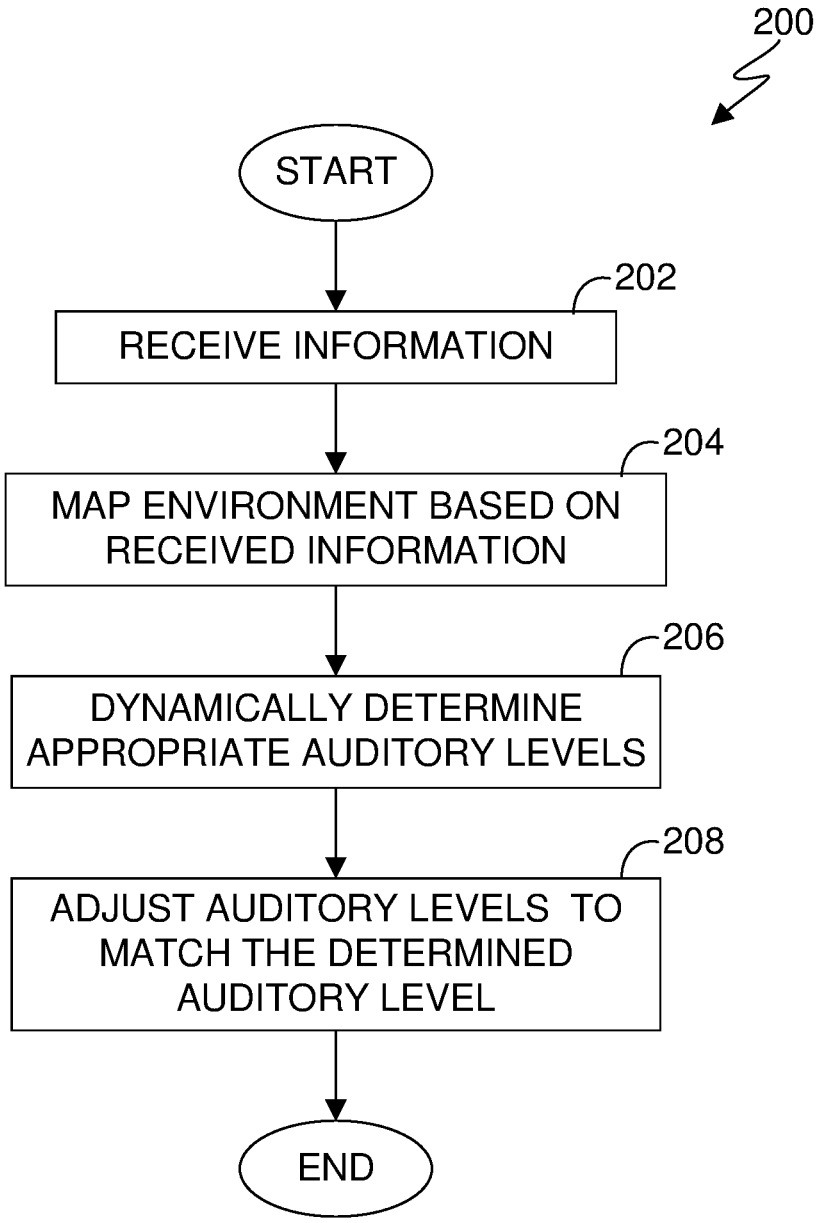
FIG. 2 is a flowchart depicting operational steps for dynamically adjusting auditory levels within an environment, in accordance with an embodiment of the present invention.

FIG. 2 is a flowchart 200 depicting operational steps for generating dynamic electrochromic visualizations, in accordance with an embodiment of the present invention.

In step 202, auditory manager 110 receives information. In this embodiment, auditory manager 110 receives a request from client computing device 102. In other embodiments, auditory manager 110 can receive information from one or more other components of computing environment 100.

Information received by auditory manager 110 refers to information pertaining to an area (i.e., location) within an environment. For example, auditory manager 110 can receive information from one or more connected IoT devices (e.g., smart speakers, sound systems, television, home automation devices, wireless devices, Bluetooth connected devices, electronic devices, etc.) and one or more service applications (e.g., weather, traffic, crowdsource databases, etc.). In some embodiments, auditory manager 110 can receive information comprising environmental layouts (e.g., blueprints of a home). In some embodiments, environmental layouts can include one or more objects (e.g., connected IoT devices, electric or gas fireplaces, furniture, pictures frames, kitchen and laundry appliances, etc.) and placement of each of the one or more objects in respective areas (e.g., rooms of the home). Environmental layouts can also include materials used in each respective area (e.g., types of wood, quartz, marble, tile, laminate, sound deadening material, etc.). Information can also include weather information (e.g., current weather and forecasted weather).

In this embodiment, auditory manager 110 can optionally transmit a request to IoT connected devices within an area to send and register respective UUIDs. For example, auditory manager 110 can request IoT devices (e.g., smart phones) to connect the devices.

In step 204, auditory manager 110 maps an environment based on received information. In this embodiment, auditory manager 110 maps an environment by identifying one or more connected devices and their respective locations to a central hub (e.g., Wi-Fi router). In this embodiment, auditory manager 110 can collect information streams from various data sources (e.g., IoT connected devices, etc.) and dynamically update the corresponding map of the environment.

In this embodiment, auditory manager 110 can discern information insights (e.g., volume levels and capabilities of respective devices capable of emitting or otherwise producing sound based on the information collected by the stream data receivers. In instances where auditory information cannot be connected, auditory manager provides a mechanism for manual input of an object's capabilities. For example, auditory manager 110 can provide a mechanism for manual input of sound levels associated with different fan speed settings of a heater or electric fan.

In this embodiment, auditory manager 110 can collect additional information from one or more other services by invoking an in-bound API which then initiates a MAC based trajectory path request for all the devices in the area. In this embodiment, an in-bound approach of communication includes control framed of MAC (Media Access Control) protocol and auditory manager 110 invokes an in-bound API across the common external data collector service in 5G domain wherein the static platform data can be accessed. In this way, auditory manager 110 can collect static data that includes platform identification, hardware specification and model internal architecture is collected from the MAC based service interconnect manager. Examples of static data can include hardware default settings. Auditory manager 110 can then parse the collected information using a regex-based document classifier and saved in metadata mappers.

In step 206, auditory manager 110 dynamically determines appropriate auditory levels. In this embodiment, auditory manager 110 dynamically determines appropriate auditory levels for a respective room based on received information using a combination of machine learning and artificial intelligence algorithms. For example, auditory manager 110 can determine an appropriate auditory level based on a user's location within an area (room) of the environment, detected sound, corresponding locations of sound emitting/producing devices, and external noises adjacent to or within the area, and whether the detected sound affects auditory levels that would negatively impact a user's listening experience as discussed in greater detail with respect to FIG. 3. Specifically, auditory manager 110 can generate an interference score indicating a threshold level of interference that corresponds to a likelihood that an object is capable of producing or otherwise emitting sound that will interfere with a listening experience of a user similarly discussed with respect to FIG. 3.

In some embodiments, auditory manager 110 can dynamically determine appropriate auditory levels based on obstacles detected in the environment. For example, auditory manager 110 can detect an object either emitting sound or obstructing sound. In this scenario, in response to determining an object emitting sound that causes interference or obstructing sound, auditory manager 110 can determine an interference score for the detected object with respect to acceptable auditory levels for a given environment based on the position of the user.

In this embodiment, auditory manager 110 can improve and refine its calculations for interference based on historical learning. In some embodiments, auditory manager 110 can dynamically create a rule for certain circumstances. For example, auditory manager 110 can identify that at a certain time, with respect to two rooms, the living room and the kitchen, different occupants of the house tend to produce and require different sound profiles. Specifically, user alpha can be watching a movie in the living room while users beta and gamma are eating and talking. Auditory manager 110 can detect the sound users beta and gamma are making and either automatically increase volume levels of the living room or alternatively transmits instructions to close a pair of French doors that separate the kitchen and living room. In instances where no rules have been made, auditory manager 110 can be pre-loaded with a set of default rules. Upon a first use of auditory manager 110, auditory manager 110 can be configured to have a baseline set of rules that can be modified over time using a combination of machine learning and prediction algorithms or by manual input of the user.

In step 208, auditory manager 110 adjusts auditory levels to match the determined auditory level. In this embodiment, auditory manager 110 adjusts auditory levels by transmitting instructions to respective controllers of IoT devices generating noise having an interference score indicative on an interference and reduce the volume of source, enable sound booster of a speaker system producing the sound, reduce the distance from the source of sound, close or open door, and in some instances, transmit instructions to a connected device to remove obstacles producing the unwanted obstacle causing the audio. For example, in some embodiments auditory manager 110 can retract window treatments (e.g., window shades, blinds, curtains, etc.) to minimize noise from outside the environment (i.e., noise coming in from the windows).

As discussed above, auditory manager 110 can be utilized with augmented reality. For example, auditory manager 110 can have an interface displayed on an augmented reality display such as smart glasses. In this embodiment, auditory manager 110 can display a layout of the environment the user is in and display images that overlays on top of physical devices to show where audio (noise or selected audio content) is coming from. For example, where multiple sounds are present adjacent to the area the user is listening, auditory manager 110 can generate graphics to overlay one or more objects and corresponding areas containing the one or more objects to highlight where the sound is coming from.

Auditory manager 110 can also display a control or command center that allows volume control over one or more detected audio. For example, where an environment comprises two rooms, auditory manager 110 can detect that Room A includes a three stereo system that is broadcasting selected audio and that room B has an object (e.g., a ceiling fan) that is generating noise or otherwise emanating audio (e.g., a creak and fan noise). In this example, auditory manager 110 determines that there are four objects that are producing noise (e.g., the three speakers in Room A and the fan in Room B. Accordingly, auditory manager 110 can generate volume icons for each of the detected objects that have a sliding graphic that, when interacted with, can adjust the volume of the detected object. In this example, auditory manager 110 can, in response to determining that the fan in Room B interferes with audio from the three speakers, can automatically adjust the fans speed of the fan to reduce wind noise and creaking. Alternatively, auditory manager 110 can transmit instructions and subsequently execute those instructions to shut off the fan thereby eliminating the interfering or unwanted noise.

Figure 3:
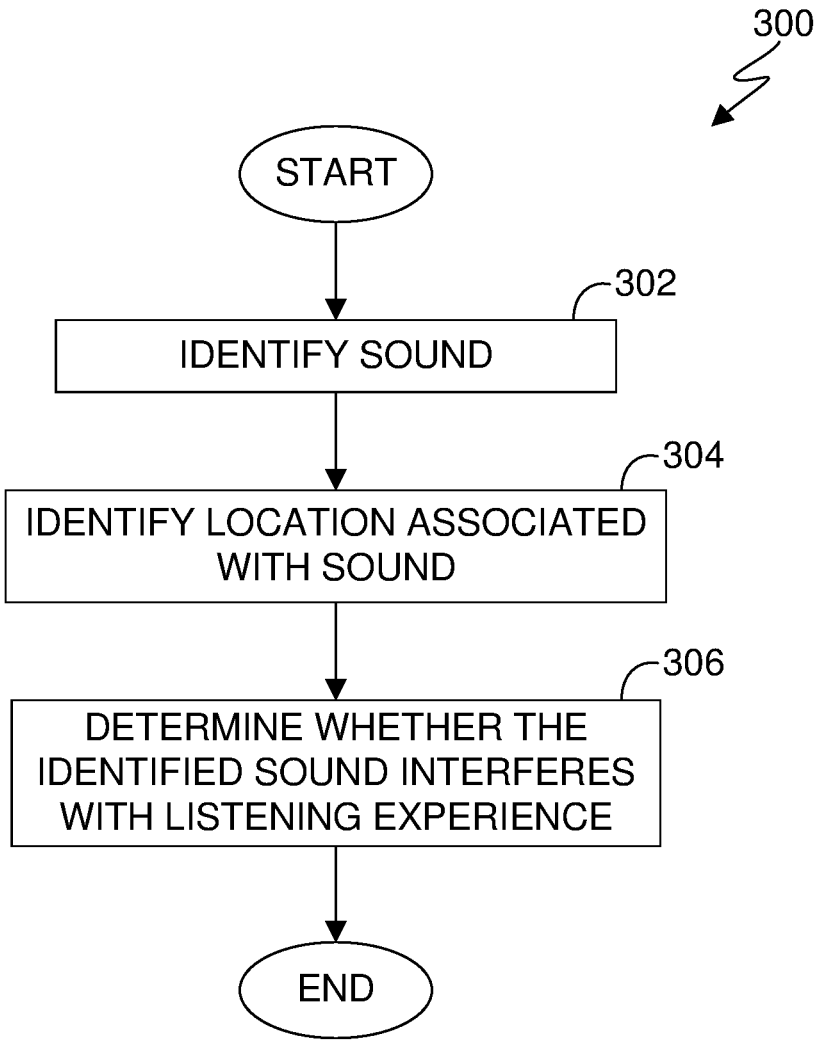
FIG. 3 is a flowchart for dynamically determining appropriate auditory levels within an environment, in accordance with an embodiment of the present invention.

FIG. 3 is a flowchart 300 for dynamically determining appropriate auditory levels within an environment, in accordance with an embodiment of the present invention.

In step 302, auditory manager 110 identifies a sound. In this embodiment, auditory manager 110 can identify a sound by detecting noise above a decibel output or otherwise detecting an audio signal from an electronic device. For example, auditory manager 110 can receive audio playback or detect audio playback from one or more connected IoT devices (e.g., smart speakers, sound systems, television, home automation devices, wireless devices, Bluetooth connected devices, electronic devices, etc.). In other embodiments, auditory manager 110 can utilize an artificial intelligence algorithm to perform sound analysis and classify the sound as either song, animal sound, human sound, vehicle sound, electronic sound, etc.

In step 304, auditory manager 110 identifies a location associated with the sound. In this embodiment, auditory manager 110 identifies a location associated with sound by measuring a distance of the electronic device to a central hub (e.g., connection point from a device to a Wi-Fi, Bluetooth, or NFC connection point). In instances where auditory manager 110 cannot identify a location via its connection to a central hub, auditory manager 110 can reference the mapped environment in conjunction with known sound localization techniques (e.g., beamforming) to determine potential locations for the detected sound.

In step 306, auditory manager 110 determines whether the identified sound interferes with a listening experience of a user. In this embodiment, auditory manager 110 determines whether the identified sound interferes with a listening experience of a user by generating an interference score. For example, auditory manager 110 can assign weight values to received information to generate an interference score. In this embodiment, an interference score indicates a threshold level of interference that indicates a likelihood that an object capable of producing or otherwise emitting sound will interfere with a listening experience of a user. For example, in this embodiment, auditory manager 110 uses a numeric scale where greater numbers indicate a higher risk while lower numbers indicate a lesser risk. Specifically, in this embodiment, where the scale is from zero to one hundred, a risk score of ninety indicates a higher risk than a risk score of ten.

In this embodiment, auditory manager 110 has three different threshold values for interference. For example, a no risk to low risk category denotes an interference level that is permissible (e.g., a risk score of ten or under in a numeric scale ranging from zero to one hundred) and that no action should be taken. Conversely, a high risk score denotes interference is likely (e.g., a risk score of ninety and above) and appropriate action needs to be taken. Scores above ten and below ninety indicate a medium risk (e.g., a notification to the user will be generated and appropriate action will be taken based on user preference). In scenarios where a medium risk is determined, auditory manager 110 can generate a notification to the user and receive manual input from the user to determine what action to take. In other embodiments, the interference threshold can be configured to any desired threshold. In general, auditory manager 110 can automatically take appropriate action when a detected object producing noise meeting or exceeding the interference threshold for high risk.

In other embodiments, auditory manager 110 can receive user information that specifies threshold levels of interference. For example, auditory manager 110 provides a mechanism for a user to specify that external noises (e.g., adjacent to the area in which the user is listening) have a decibel limit of forty. For example, a user can specify a contextual situation, types of sound, and create a rule that can be executed by auditory manager 110 when those conditions (i.e., contextual situations) are met.

In instances where there are multiple users, each having respective user profiles for audio (e.g., unique audio preferences designed to optimize listening for an area within an environment), that may cause interference with one another (e.g., where user alpha is watching a movie in the living room and user beta is having a conversation in the adject dining room, where user alpha is watching a movie and user beta has turned on the washer and dryer in the adjacent room, etc.), auditory manager 110 can optimize a sound profile that minimizes interference for both of the users. In certain embodiments, auditory manager 110 can transmit a notification to each of the user and allow for manual input. In other embodiments, auditory manager 110 can prioritize users based on a user's priority status (e.g., a parent or owner of the system as opposed to a child or guest).

Figure 4:
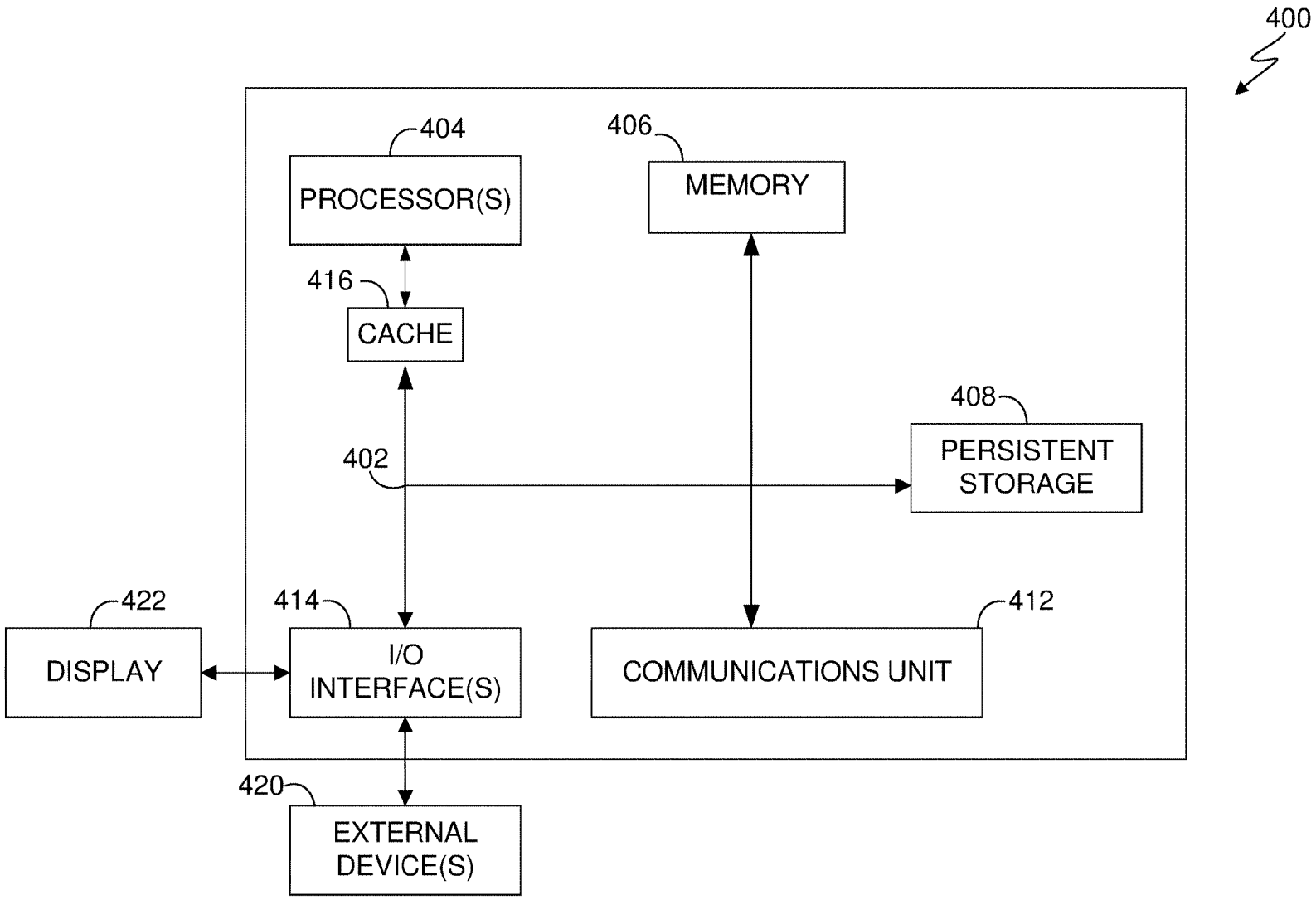
FIG. 4 is a block diagram of an example system, in accordance with an embodiment of the present invention.

FIG. 4 depicts a block diagram of components of computing systems within computing environment 100 of FIG. 1, in accordance with an embodiment of the present invention. It should be appreciated that FIG. 4 provides only an illustration of one implementation and does not imply any limitations with regard to the environments in which different embodiments can be implemented. Many modifications to the depicted environment can be made.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

Computer system 400 includes communications fabric 402, which provides communications between cache 416, memory 406, persistent storage 408, communications unit 412, and input/output (I/O) interface(s) 414. Communications fabric 402 can be implemented with any architecture designed for passing data and/or control information between processors (such as microprocessors, communications and network processors, etc.), system memory, peripheral devices, and any other hardware components within a system. For example, communications fabric 402 can be implemented with one or more buses or a crossbar switch.

Memory 406 and persistent storage 408 are computer readable storage media. In this embodiment, memory 406 includes random access memory (RAM). In general, memory 406 can include any suitable volatile or non-volatile computer readable storage media. Cache 416 is a fast memory that enhances the performance of computer processor(s) 404 by holding recently accessed data, and data near accessed data, from memory 406.

Auditory manager 110 (not shown) may be stored in persistent storage 408 and in memory 606 for execution by one or more of the respective computer processors 404 via cache 416. In an embodiment, persistent storage 408 includes a magnetic hard disk drive. Alternatively, or in addition to a magnetic hard disk drive, persistent storage 408 can include a solid state hard drive, a semiconductor storage device, read-only memory (ROM), erasable programmable read-only memory (EPROM), flash memory, or any other computer readable storage media that is capable of storing program instructions or digital information.

The media used by persistent storage 408 may also be removable. For example, a removable hard drive may be used for persistent storage 408. Other examples include optical and magnetic disks, thumb drives, and smart cards that are inserted into a drive for transfer onto another computer readable storage medium that is also part of persistent storage 408.

Communications unit 412, in these examples, provides for communications with other data processing systems or devices. In these examples, communications unit 412 includes one or more network interface cards. Communications unit 412 may provide communications through the use of either or both physical and wireless communications links. Auditory manager 110 may be downloaded to persistent storage 508 through communications unit 412.

I/O interface(s) 414 allows for input and output of data with other devices that may be connected to client computing device and/or server computer. For example, I/O interface 414 may provide a connection to external devices 420 such as a keyboard, keypad, a touch screen, and/or some other suitable input device. External devices 420 can also include portable computer readable storage media such as, for example, thumb drives, portable optical or magnetic disks, and memory cards. Software and data used to practice embodiments of the present invention, e.g., auditory manager 110, can be stored on such portable computer readable storage media and can be loaded onto persistent storage 408 via I/O interface(s) 414. I/O interface(s) 414 also connect to a display 422.

Display 422 provides a mechanism to display data to a user and may be, for example, a computer monitor.

The present invention may be a system, a method, and/or a computer program product. The computer program product may include a computer readable storage medium (or media) having computer readable program instructions thereon for causing a processor to carry out aspects of the present invention.

The computer readable storage medium can be any tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, a special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, a segment, or a portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the invention. The terminology used herein was chosen to best explain the principles of the embodiment, the practical application or technical improvement over technologies found in the marketplace, or to enable others of ordinary skill in the art to understand the embodiments disclosed herein.

What is claimed is:

1. A computer-implemented method comprising:

mapping an environment comprising one or more locations having respective objects located within each of the one or more locations based on received information;

dynamically determining appropriate auditory levels for the environment, wherein dynamically determining appropriate auditory levels for the environment comprises:

determining whether an identified sound interferes with a listening experience of a user, and generating a graphic icon for display on an augmented reality device that overlays on an object emitting the identified sound; and adjusting auditory levels of each of the one or more locations within the environment to match the determined auditory level.

2. The computer-implemented method of claim 1, further comprising:

generating one or more graphic icons for a volume control associated with the object; and in response to a user interacting with the one or more graphic icons, adjusting a volume control for the object such that a volume of an environment is optimized.

3. The computer-implemented method of claim 1, wherein determining whether the identified sound interferes with a listening experience of a user comprises:

generating an interference score for a detected object within producing a sound; and in response generated interference score for the detected object exceeding a threshold, generating a notification for the user.

4. The computer-implemented method of claim 1, wherein adjusting auditory levels to match the determined auditory level comprises:

automatically executing actions to ensure a same level of audio volume can be maintained to an optimal location for the user.

5. The computer-implemented method of claim 3, wherein an action comprises:

increasing or decreasing loudness of an identified noise at a respective source location, bringing an object causing the identified noise to the user or away from the user, closing or opening a window to control a volume level of the identified noise outside of the environment, and enabling or disabling a sound booster associated with the identified noise.

6. The computer-implemented method of claim 2, further comprising:

in response to detecting multiple users, each user having respective profiles for audio that may cause interference with each other, optimizing a sound profile such that sounds produced by each respective user of the multiple users is minimized.

7. A computer program product comprising:

one or more computer readable storage media and program instructions stored on the one or more computer readable storage media, the program instructions comprising:

program instructions to map an environment one or more locations having respective objects located within each of the one or more locations based on received information;

program instructions to dynamically determine appropriate auditory levels for the environment, wherein the program instructions to dynamically determine appropriate auditory levels for the environment comprise:

program instructions to determine whether an identified sound interferes with a listening experience of a user, and program instructions to generate a graphic icon for display on an augmented reality device that overlays on an object emitting the identified sound; and program instructions to adjust auditory levels of each of the one or more locations within the environment to match the determined auditory level.

8. The computer program product of claim 7, wherein the program instructions stored on the one or more computer readable storage media further comprise:

program instructions to generate one or more graphic icons for a volume control associated with the object; and program instructions to, in response to a user interacting with the one or more graphic icons, adjust a volume control for the object such that a volume of an environment is optimized.

9. The computer program product of claim 7, wherein the program instructions to determine whether the identified sound interferes with a listening experience of a user comprise:

program instructions to generate an interference score for a detected object within producing a sound; and program instructions to, in response generated interference score for the detected object exceeding a threshold, generate a notification for the user.

10. The computer program product of claim 7, wherein the program instructions to adjust auditory levels to match the determined auditory level comprise:

program instructions to automatically execute actions to ensure a same level of audio volume can be maintained to an optimal location for the user.

11. The computer program product of claim 10, wherein an action comprises:

program instructions to increase or decrease loudness of an identified noise at a respective source location, bring an object causing the identified noise to the user or away from the user, close or open a window to control a volume level of the identified noise outside of the environment, and enable or disable a sound booster associated with the identified noise.

12. The computer program product of claim 9, wherein the program instructions stored on the one or more computer readable storage media further comprise:

program instructions to, in response to detecting multiple users, each user having respective profiles for audio that may cause interference with each other, optimize a sound profile such that sounds produced by each respective user of the multiple users is minimized.

13. A computer system comprising:

one or more computer processors;

one or more computer readable storage media; and program instructions stored on the one or more computer readable storage media for execution by at least one of the one or more computer processors, the program instructions comprising:

program instructions to map an environment one or more locations having respective objects located within each of the one or more locations based on received information;

program instructions to dynamically determine appropriate auditory levels for the environment, wherein the program instructions to dynamically determine appropriate auditory levels for the environment comprise:

program instructions to determine whether an identified sound interferes with a listening experience of a user, and program instructions to generate a graphic icon for display on an augmented reality device that overlays on an object emitting the identified sound; and program instructions to adjust auditory levels of each of the one or more locations within the environment to match the determined auditory level.

14. The computer system of claim 13, wherein the program instructions stored on the one or more computer readable storage media further comprise:

program instructions to generate one or more graphic icons for a volume control associated with the object; and program instructions to, in response to a user interacting with the one or more graphic icons, adjust a volume control for the object such that a volume of an environment is optimized.

15. The computer system claim 13, wherein the program instructions to determine whether the identified sound interferes with a listening experience of a user comprise:

program instructions to generate an interference score for a detected object within producing a sound; and program instructions to, in response generated interference score for the detected object exceeding a threshold, generate a notification for the user.

16. The computer system of claim 13, wherein the program instructions to adjust auditory levels to match the determined auditory level comprise:

program instructions to automatically execute actions to ensure a same level of audio volume can be maintained to an optimal location for the user.

17. The computer system of claim 16, wherein an action comprises:

program instructions to increase or decrease loudness of an identified noise at a respective source location, bring an object causing the identified noise to the user or away from the user, close or open a window to control a volume level of the identified noise outside of the environment, and enable or disable a sound booster associated with the identified noise.

* * * * *